United States Patent [19]

Beuchat

[11] Patent Number: 4,831,729

[45] Date of Patent: May 23, 1989

[54] RAZOR SET

[76] Inventor: Roland Beuchat, Ch. des Fours 4, 1223 Cologny, Switzerland

[21] Appl. No.: 26,726

[22] PCT Filed: Jun. 28, 1986

[86] PCT No.: PCT/EP86/00412

§ 371 Date: Feb. 19, 1987

§ 102(e) Date: Feb. 19, 1987

[87] PCT Pub. No.: WO87/00113

PCT Pub. Date: Jan. 15, 1987

[30] Foreign Application Priority Data

Jul. 4, 1985 [CH] Switzerland ..... 02876/85

[51] Int. Cl.[4] ..... B26B 21/24

[52] U.S. Cl. ..... 30/40.2; 30/86

[58] Field of Search ..... 30/85, 86, 40, 40.2, 30/90, 27, 26, 30, 31, 53–55; 206/352, 354

[56] References Cited

U.S. PATENT DOCUMENTS

| | | | |
|---|---|---|---|
| 1,476,508 | 12/1923 | Hart | 30/27 |
| 2,630,625 | 3/1953 | Kleinmann et al. | 30/40.2 |
| 3,728,788 | 4/1973 | Pearson | 30/53 |
| 3,967,375 | 7/1976 | Hoffschmidt | 30/47 |
| 3,970,194 | 6/1976 | Iten | 30/40.2 X |
| 4,182,031 | 1/1980 | Cecil, Jr. | 30/47 |
| 4,272,886 | 6/1981 | Asano | 30/47 |
| 4,612,704 | 9/1986 | Berretti | 30/86 |

FOREIGN PATENT DOCUMENTS

| | | | |
|---|---|---|---|
| 0150160 | 7/1985 | European Pat. Off. . | |
| 2907275 | 9/1980 | Fed. Rep. of Germany . | |
| 376901 | 4/1907 | France | 30/27 |

*Primary Examiner*—Douglas D. Watts

*Attorney, Agent, or Firm*—Young & Thompson

[57] ABSTRACT

A razor set comprises an L-shaped handle having one leg with slides for receiving a razor head, and the other leg to be grasped as a handle by the user. The other leg serves to support a razor head or a receptacle for a razor head to be detachably slidably inserted on the one leg. The receptacle can be provided in the other leg or can slide on the other leg, either parallel or perpendicular thereto.

7 Claims, 2 Drawing Sheets

RAZOR SET

The present invention relates to a razor set which has desirable qualities, not only as to its appearance, but also as to its ease of use and its small size.

Generally, razor sets are in the form of a box in which are disposed a handle and a blade box generally constituted by a magazine.

The box is necessary, to keep together the handle and the magazine for the blades during transport, and, in its traditional shape, is bulky.

The present invention overcomes this difficulty by providing a razor set which is compact, complete, and small in size. This set comprises a handle and a razor head adapted to be fixed to the handle in service position by means of a member provided on the handle. This set is characterized in that the handle comprises receiving means for at least one razor head in storage position.

The razor head or heads can be placed in a box and the handle then forms a housing for the box.

In other words, the razor set has the form of a compact assembly the parts of which can be separated during use.

The razor head can be of any known type, for example by the type comprising one or two parallel blades received in a support. Only the edge of the blade emerges, in order to cut the whiskers.

The box may contain only one razor head or it can be in the form of a magazine containing several razor heads.

The box can be simply secured to the handle, for example by means of slides. In another embodiment, the handle constitutes a casing for one razor head or for the box (or for the magazine) which contains it. It is maintained assembled by friction.

In other words, the handle has the double function of maintaining the head in service position during shaving and to constitute a receptable for at least one razor head or a box, or to perform the function of a housing for a blade or for a box housing several razor blades.

In each case, the razor heads can be disposed parallel or perpendicular to the handle. Preferably, the handle is straight and has the shape of an L or has the shape of a T. When the handle is straight, having the shape of an I, it preferably has on its sides two curves directed inwardly, adapted to let it be gripped, to position the hand of the user, and to make easier the extraction of the box which contains the head or the razor heads.

The securement of the razor head in service position on the handle can be effected by means of any conventional member, for example by slides or by an articulated mechanism providing a pivoting head.

Preferably, this securement member has a conduit under the razor head and parallel to it, so as to enable its rinsing.

In another embodiment, the razor set is constituted by two identical handles, one fitting into the other, each of these handles comprising a housing for one or several razor heads. The two handles are maintained together for example by means of slides or clips.

The invention will be better understood with reference to the accompanying drawings, given by way of non-limiting example. In the drawings.

Figure 1:
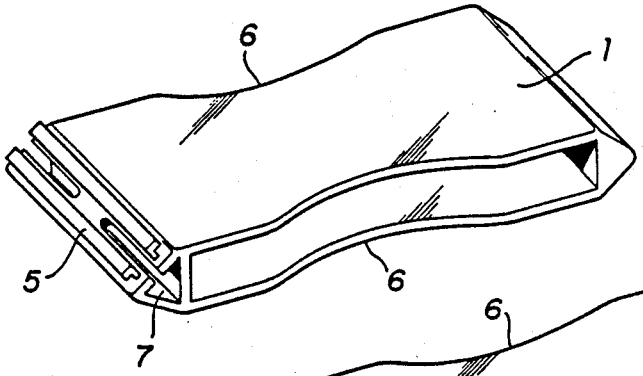
FIGS. 1, 2 and 3 show the razor set according to a first embodiment of the invention.

As can be seen from FIGS. 1, 2, 3 and 4, the razor set comprises a handle 1 and razor heads 2 comprising each one blade 3, mounted in a support 4. A member 5 provided on the handle 1 permits fixing the razor head 2 in service position onto the handle.

The razor heads 2 are disposed in a magazine 20. The handle 1 constitutes a housing for the magazine 20. On the other hand, this handle 1 is substantially straight and comprises, on the sides, two curves 6 directed inwardly and adapted to facilitate gripping by the hand of the user, and to make it easy to remove the magazine 20 with lateral pressure.

Figure 2:
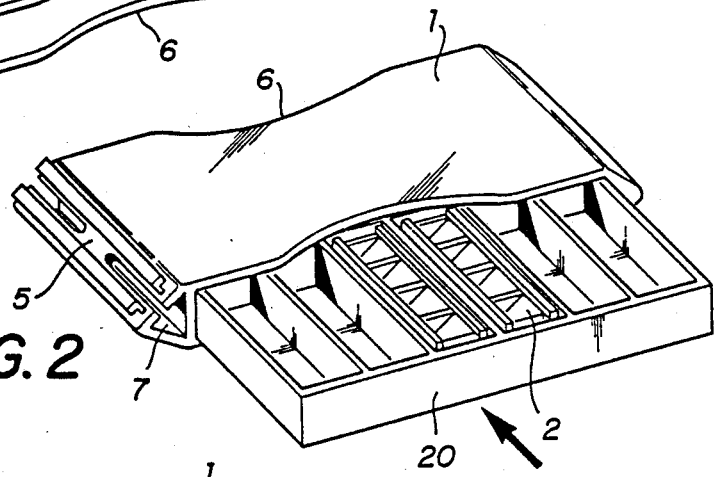
Figure 3:
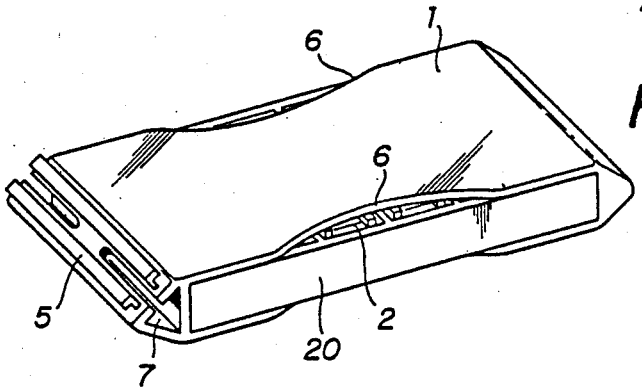

The magazine 20 can be disposed as seen in FIG. 2, or can be inverted, there being also an aperture on the other side.

The handle 1 can have on one side abutments preventing the emergence of the magazine 20 from this side. However, it is preferred not to have such abutments and have a tight sliding fit permitting the magazine to emerge from either side as desired by the user. The razor set can then be convenient for left hand or right hand users.

Figure 4:
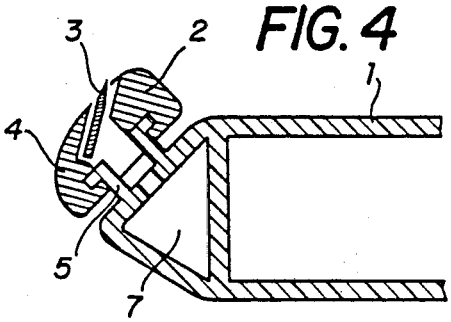
FIG. 4 is an enlarged cross section of the end of the set, the razor head being secured to the handle.

As will be seen from FIG. 4, the razor head 2 comprises a blade 3 received in a support 4, and is fixed on the handle 1 in service position by a fixing member 5 such as slides. In this region, the handle is hollow and beneath the razor head 2 is a conduit 7 which permits rinsing. Water can enter perpendicular to the plane of the drawings so that at least a part of its passes through the conduit 7 and comes into contact with the blade 3 and emerges along the blade, taking with it the whiskers and shaving soap.

It should be understood that for simplicity of drawing and description, the fixing member 5 between the handle 1 and the razor head 2 has been shown as slides. However, any other arrangement would be suitable, for example a hinge mechanism providing a pivoting head.

In the same manner, the blade 3 has been represented as being a single blade. However, this blade could be double or multiple.

In a modification, the portion of the handle 1 forming a housing could receive directly one or several razor heads 2. In the case, ribs perpendicular to the axis of the handle can be provided to position the razor heads beside each other and to maintain them in storage position within the handle.

Figure 5:
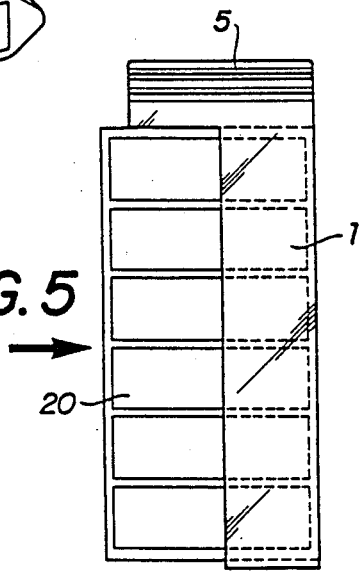
FIGS. 5, 6 and 7 show other embodiments.

In FIG. 5, the handle 1 has the general shape of an L and constitutes a housing for a magazine 20. The razor head 2 being secured in service position by slides 5. In that figure, which is a top view, the handle partially contains the magazine 20. The razor heads 20, and thus the blades 3, are located in storage position perpendicular to the axis of the handle 1.

Figure 6:
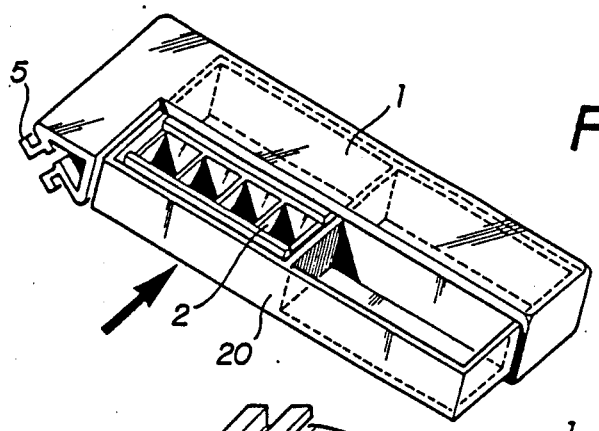

In FIG. 6, which shows another embodiment and is a perspective view, the same elements are shown as in FIG. 5, and the handle, having the general shape of an L, receives the magazine 20. The razor heads 2 are located in storage position in this instance in a longitudinal direction, parallel to the axis of the handle 1, and some of them are completely disposed within the handle. Means can be provided to secure the razor heads in the magazine by clips, friction, etc.

In a modification, the box 20 could comprise only two razor heads and could be entirely located within the handle 1.

Figure 7:
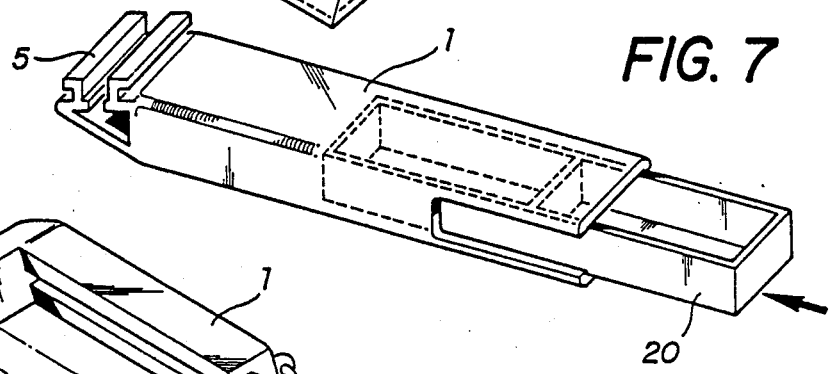

In FIG. 7, the handle 1 constitutes a housing for a magazine 20 which is slidably introduced through the end of the handle, that is, its end opposite the slides 5. It is maintained by friction, as in all the preceding embodiments. A longitudinal opening is provided in one of the walls of the handle 1 permitting the easy extraction of the box from the handle.

In all these embodiments or modifications, it can be seen that the fixing member 5 in the form of slides can also serve advantageously to remove the razor head 2 from the magazine.

Figure 8:
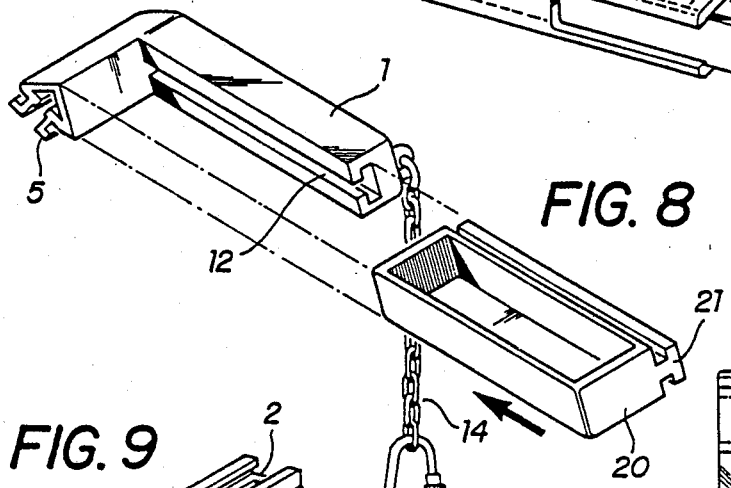
FIG. 8 shows an embodiment in which the handle has receiving means for a blade box, without providing a casing.

In FIG. 8, the handle 1 does not constitutes a case, but comprises simply receiving means for the box 20. The handle 1 of the box 20 fit into each other by sliding, there being a male formation 21 of T-shape of the box 20 and a corresponding T-shaped groove 12 provided in the handle 1.

The razor head or heads in storage position in the box are maintained there by suitable means such as clips, friction, etc.

In order to show the ready availability of the razor set, its compactness and its reduced size, it has been shown in FIG. 8 in the shape of a keyholder, a ring 13 receiving the keys being fixed to the handle 1 by a chain 14.

Figure 9:
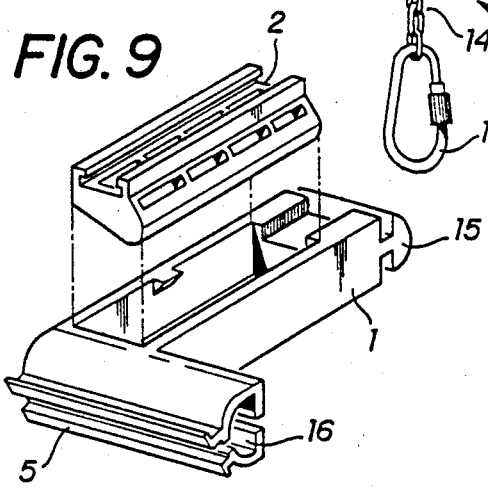
FIGS. 9 and 10 show an embodiment in which two identical handles fit into each other.

In FIG. 9 is shown a handle 1 which directly constitutes a case for a razor head 2, which is located in storage position within the handle 1. A molded formation in the handle merges into the housing receiving the razor head and maintains it in storage position within this housing. The handle 1 comprises, as an extension, that is, at its end opposite the fixing member 5, a slide 15 and has a corresponding housing 16 provided in the portion comprising the fixing member 5, which in this case also slides. Here the housing 16 serves also as a rinsing conduit.

Figure 10:
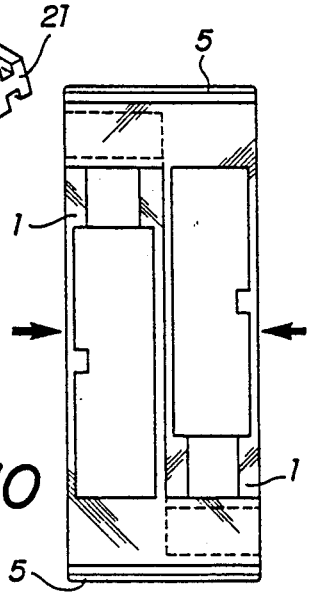

A similar handle 1 which can also receive a razor head 2 is fitted onto the first handle 1 by the members 15 and 16. It is then in the position shown in FIG. 10, wherein the two handles 1, fitted into each other, form a single assembly with, at each end, slides 5 for securing a razor head in service position. This razor head is double. The slides 5 of one handle 1 are also used to remove the razor head 2 from the other handle 1.

In an unillustrated modification, the two handles 1 can be fitted one into the other by clipping, by means of members forming a mortise and tenon, disposed in the extension of the handles 1. Each handle 1 has its pin and its mortise which correspond to each other.

From the preceding can be seen the advantages of this invention and the handiness of the razor set, which can be taken on travel without any risk of loose parts. Its small size also enables carrying it in a small toilet bag or simply in a pocket.

The curvatures of the handle describee in the embodiment of a handle having the shape of an I can be used on handles having the shape of an L or a T.

The handles having the shape of an L or a T have the further advantage of making possible automatic centering of the blade. The L-shaped handles save space and have a reduced size.

What is claimed is:

1. A razor set comprising an L-shaped handle having two legs at right angles at each other, means on one of said legs for slidably lengthwise receiving an elongated razor head with the elongated razor head disposed parallel to the length of said one leg, and means on the other leg for receiving and storing at least one said razor head.

2. A razor set as claimed in claim 1, said one leg extending from said other leg in one direction, said razor head being disposed beside said other leg in said one direction.

3. A razor set as claimed in claim 2, and slide means on said other leg coacting with slide means on a box containing said at least one razor head, releasably to secure said other leg and said box to each other by lengthwise sliding movement.

4. A razor set as claimed in claim 3, said one leg serving as a stop to limit sliding movement of said box relative to said other leg.

5. A razor set as claimed in claim 1, said one leg extending from said other leg in one direction, a box containing said at least one razor blade being slidable into and out of said other leg by sliding movement in said one direction.

6. A razor set as claimed in claim 5, said box being elongated in the direction of said other leg and extending at least most of the length of said other leg.

7. A razor set as claimed in claim 1, said at least one razor head being insertable in and removable from said other leg by movement in a direction perpendicular to both of said legs.

* * * * *